United States Patent [19]

Viry

[11] Patent Number: 5,036,641

[45] Date of Patent: Aug. 6, 1991

[54] METALLIC STRUCTURE

[75] Inventor: Bernard Viry, Golbey, France

[73] Assignee: Société Viry S.a., Eloyes, France

[21] Appl. No.: 420,331

[22] Filed: Oct. 12, 1989

[30] Foreign Application Priority Data

Oct. 17, 1988 [FR] France ..... 88 14068

[51] Int. Cl.[5] ..... E04H 12/18

[52] U.S. Cl. ..... 52/646; 52/648

[58] Field of Search ..... 52/646, 648, 81, 80

[56] References Cited

U.S. PATENT DOCUMENTS

| | | | |
|---|---|---|---|
| 2,704,522 | 3/1955 | Frieder et al. | 52/646 X |
| 3,410,036 | 11/1968 | Brell | 52/648 X |
| 3,978,634 | 9/1976 | Mack et al. | 52/646 |
| 4,584,810 | 4/1986 | Hill | 52/648 |
| 4,757,650 | 7/1988 | Berger | 52/80 X |

FOREIGN PATENT DOCUMENTS

| | | | |
|---|---|---|---|
| 2626026 | 7/1989 | France | 52/648 |

OTHER PUBLICATIONS

Makowski, ing Z.S., "Räumliche Tragwerke Aus Stahl", Verlag Stahlersen m.b.H., Dusseldorf, 1963, p. 197 (FIG. 220k).

*Primary Examiner*—Richard E. Chilcot, Jr.
*Assistant Examiner*—Lan Mai
*Attorney, Agent, or Firm*—Morgan & Finnegan

[57] ABSTRACT

A building structure has a plurality of tapered beams interlocked with each other so that their upper portions form an upper sheet and their lower portions form a lower sheet. Each beam portion is made from a plurality of standard tubular elements, the upper and lower sheets being connected by vertical struts.

10 Claims, 14 Drawing Sheets

METALLIC STRUCTURE

This invention relates to a new metallic structure intended for covering any building or architectural area of any kind, said structures being improved as for their easy use, their high mechanical properties, their aesthetics and their easy maintenance.

Such a structure can be scientifically named a "a spacial lattice with variable inertia," somewhat similar to a modern airplane wing flexible enough to shape itself according constantly variable stresses resulting to disturbance flown through at high speed.

Presently used metallic structures have already many advantages, including aesthetic originality and mechanical properties which makes them of high value in high grade architectural achievements. However a recognized limitation to their use is their unique character, resulting itself from the complexity of their constitution, a consequence of an optimisation of the use of their elements, so that their spread is limited to public or parapublic buildings or areas.

The invention has for its purpose to remove such a limitation by decreasing the cost of building said structures and increasing their availability to be used for covering any kind of building of any shape and any dimension, by using a small number of standard elements, connected according standard modules meeting optimum mechanical behaviour standards and able to be handled by an even non specialized staff.

To this effect the invention provides a new structure comprising a number, multiple of four, of substantially identical tapered beams interlocked each other in such a manner that their upper portions establish an upper sheet and their lower portions establish a lower sheet, both upper and lower portions meeting along edge beams, said portions being formed with standard elements connected along a pattern the apexes of which are standard connecting elements used as bearing for standard vertical struts kept under compression strenghth by said both sheets and absorbing their stresses.

Basically the structure according to this invention can be defined as at least one parallelepipedic cell closed by two rounded sheets and four vertical lateral walls, the overall structure comprising a lattice made of an assembly of said juxtaposed cells gradually flattening towards the external edges of the structure where are finally taken back and counterbalanced all stresses.

According to a preferred modification of the invention the elements of the structure are prestressed. However, as it will be further discussed hereunder, the invention also comprises structures of this type in which, for dimensional or purpose grounds, said elements are post-stressed.

The practical use of the invention will be shown further in this specification with some examples of illustration, but it appears useful to give first an explanation of the principles of the invention with reference to FIG. 16 of the attached drawings.

In this FIG. 16, the references F1, F2, F3, and F4 show four tapered beams interlocked in forming a cell with two rounded faces ABCD and EFGH connected by vertical struts AE, BF, CG, and DH. If each side AB, BC, CD and DA of face ABCD has been stretched before connecting face ABCD with face EFGH through struts AE, BF, CG and DH, and if each side of the face EFGH is stretched under proper stress the overall stresses in the cell are fully counterbalanced.

The structure of the invention comprises a juxtapostion of such cells gradually flattening along the successive tapered beams until points S, T, U, V, W, X, Y and Z to form four edges ST, UV, WX and YZ limiting an overall structure having the shape of a cushion and in which all stresses are counterbalanced along said edges which can be the edge beams of a building upon which is lying a roof comprising said structure covered with any web, of usual nature or not.

Such a roof is simple and cheap to realize, since it comprises only six standard elements:

upper tubular element, to be possibly prestressed,
lower brace, of adjustable lenghth,
upper connecting element,
lower connecting element
vertical strut
edge connecting element.

Each standard element can be of various dimensions according to the final application, but in all cases it is completed in factory, including the surface treatments, so that all elements can be shipped in building kits of maximal density, no further treatment being required after building, which prevent from any further costs of checking and maintenance of the final structure.

The invention will be further described with reference to some modifications and examples of realizations, and to the attached drawing on which, in addition to FIG. 16.

Figure 6:
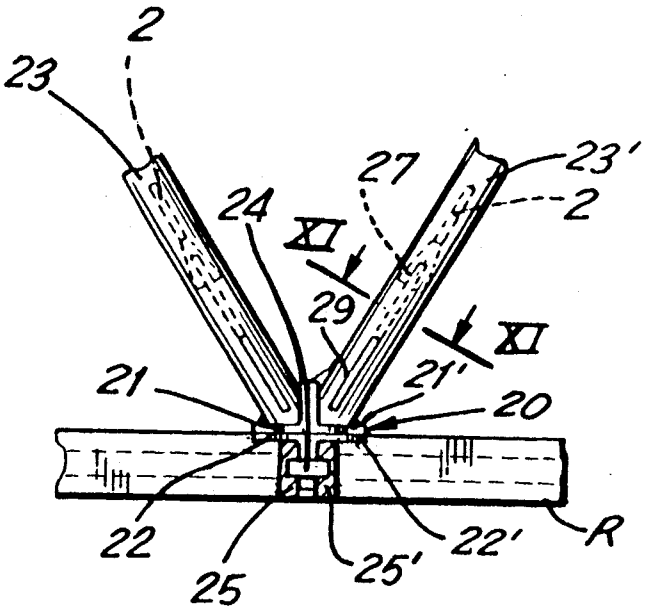
FIG. 6 is a top view of FIG. 5.
Figure 11A:
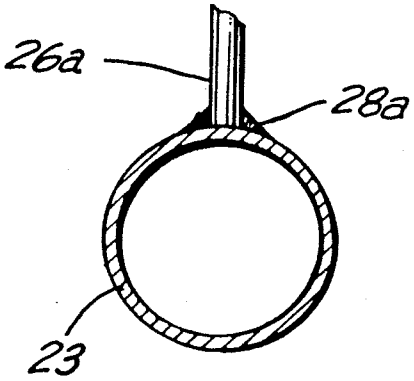
Figure 11B:
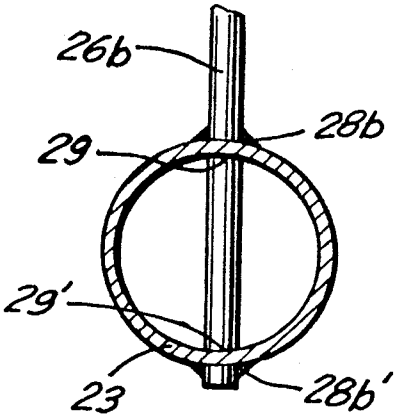

FIG. 11*a* and 11*b* are transverse sections of two modifications of FIG. 6, along XI—XI of said FIG. 6.

Figure 12:
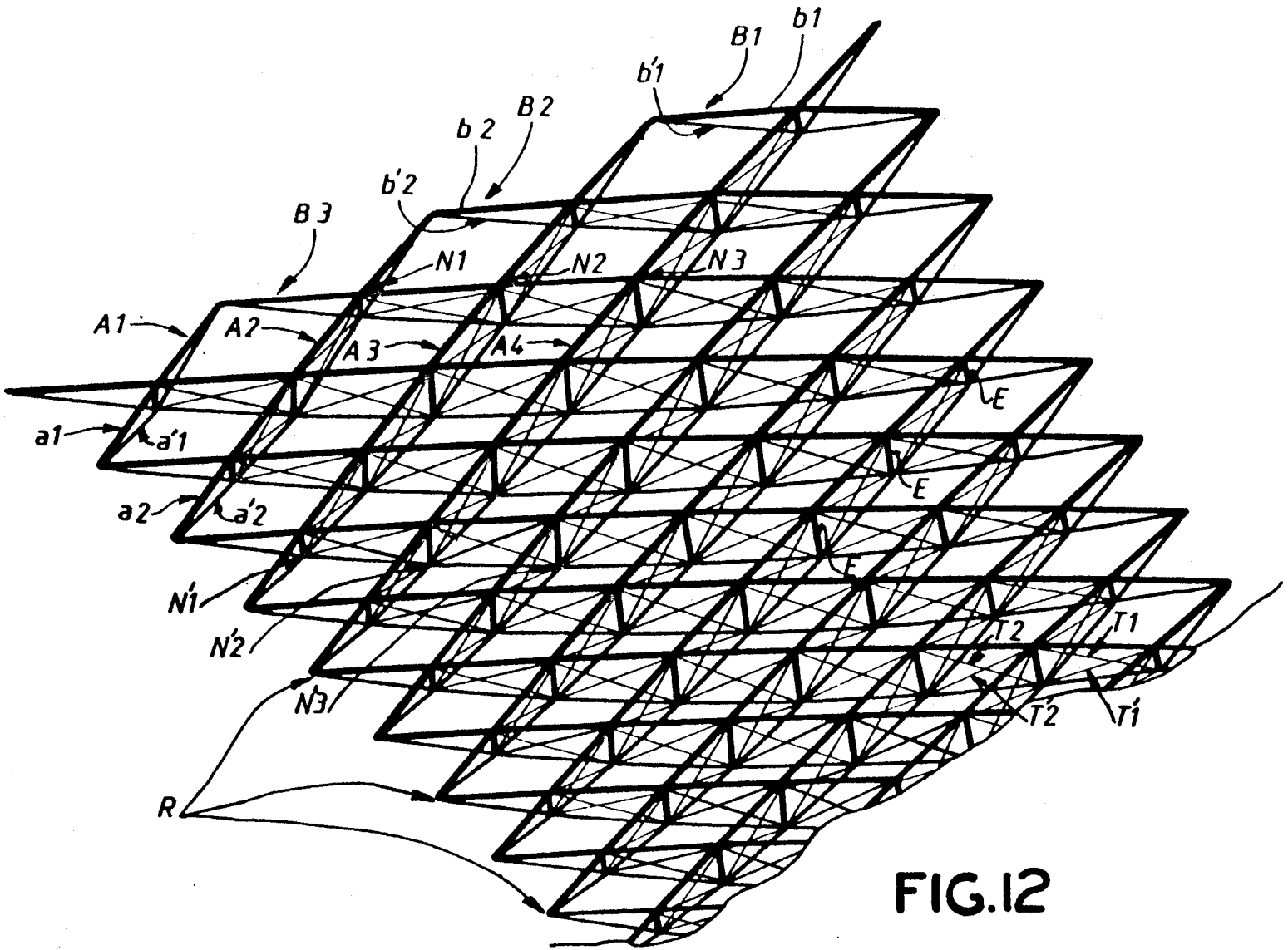

FIG. 12 is a perspective view of a part of a complete structure of the invention.

Figure 12A:
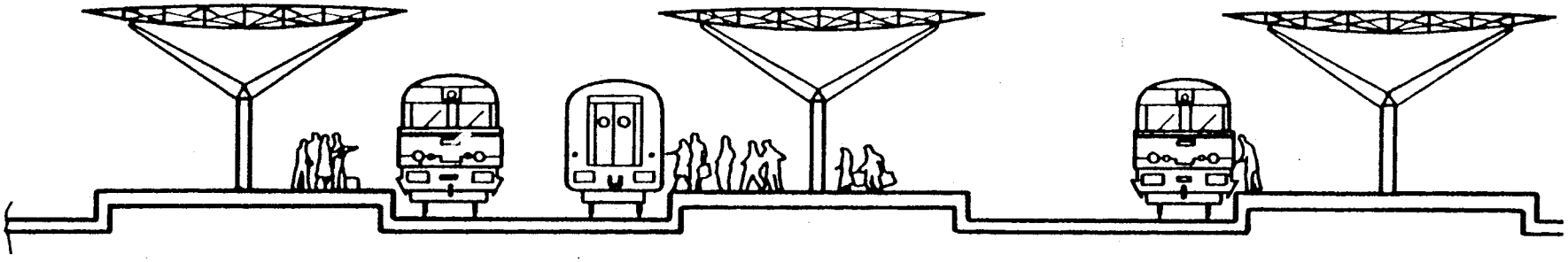
Figure 12B:
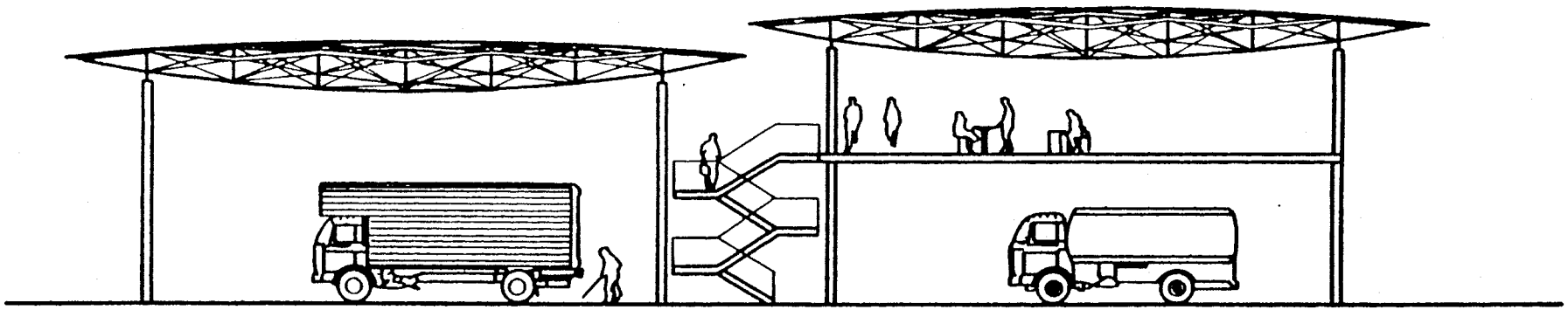
Figure 12C:
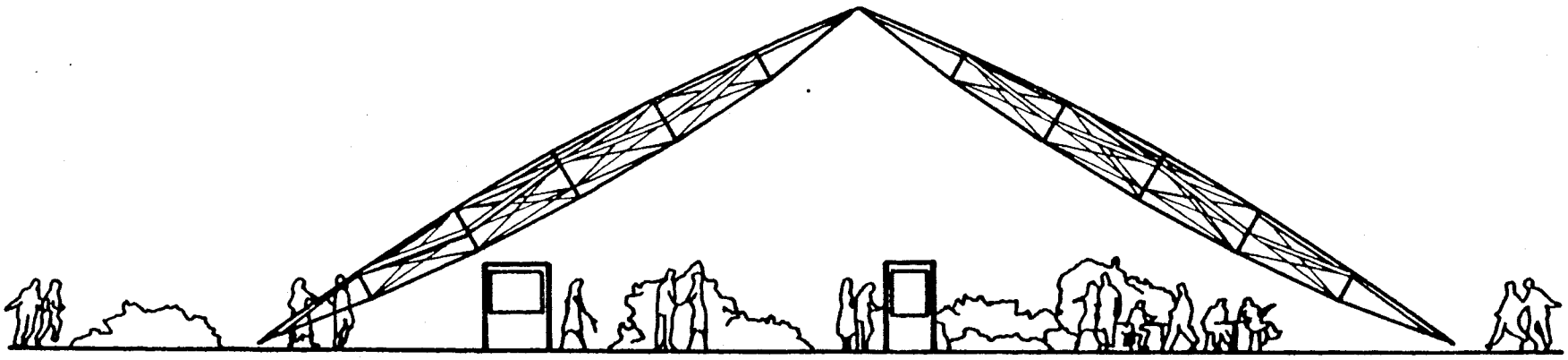

FIGS. 12A, 12B, and 12C show some uses of said structure.

Figure 13:
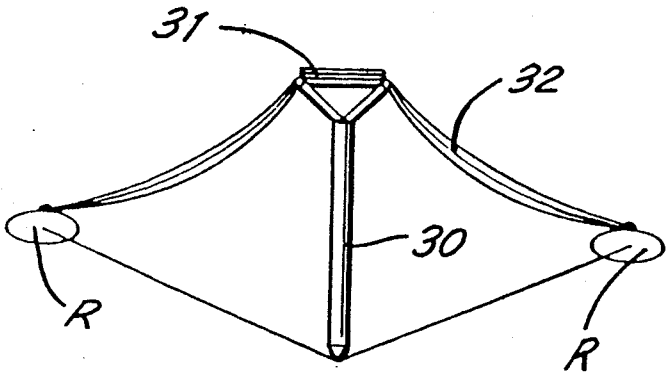

FIG. 13 is a modification of said structure, adapted to sophisticated architectural purposes.

Figure 14:
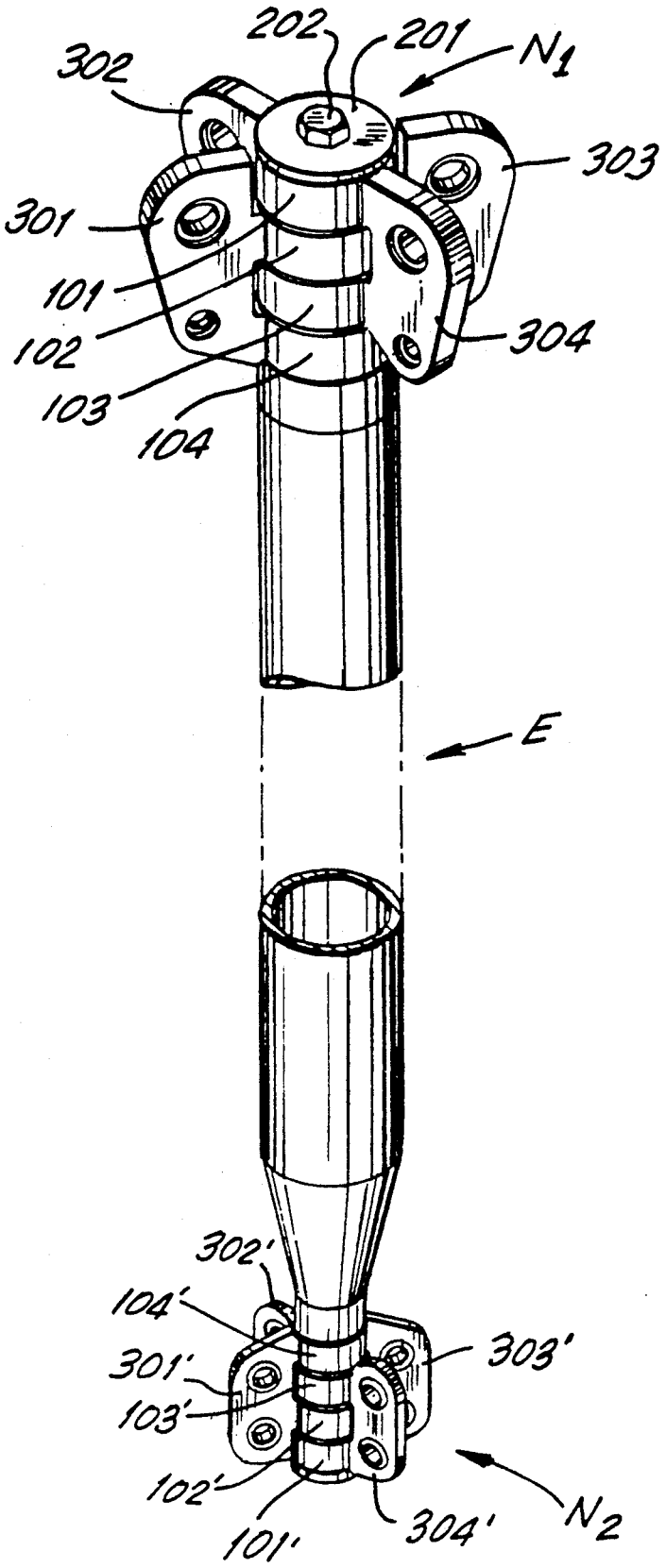
Figure 15:
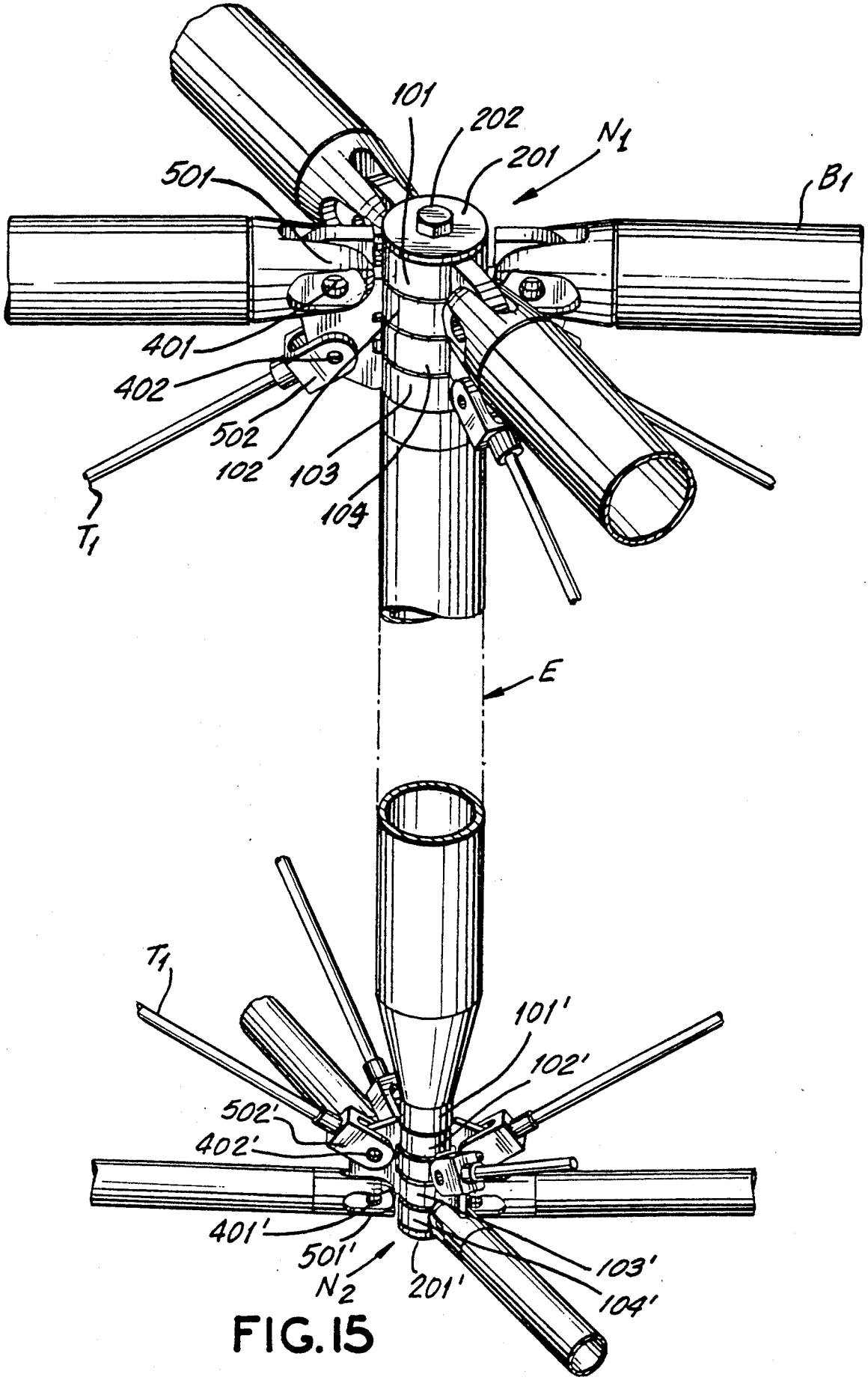

FIG. 14 shows a modification of the connecting points at the struts ends, and FIG. 15 is a view similar to FIG. 14 with the upper and lower elements in place.

Figure 1:
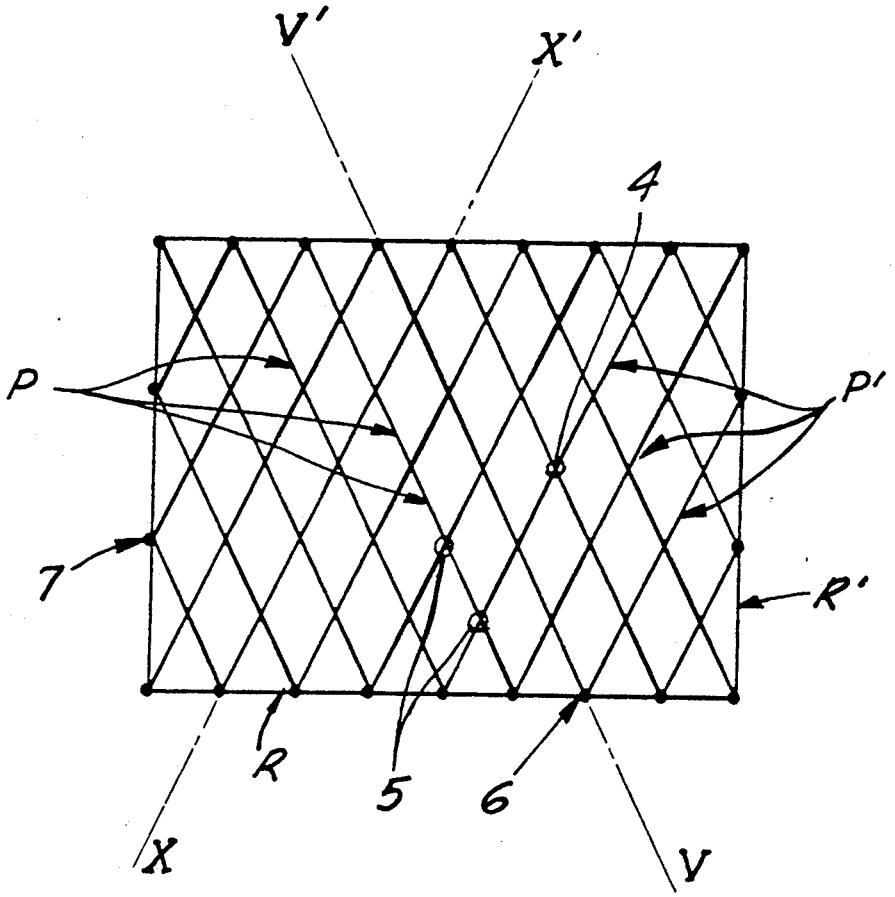
FIG. 1 is a schematic top view of an overall structure build along the principles of the invention.
Figure 2:
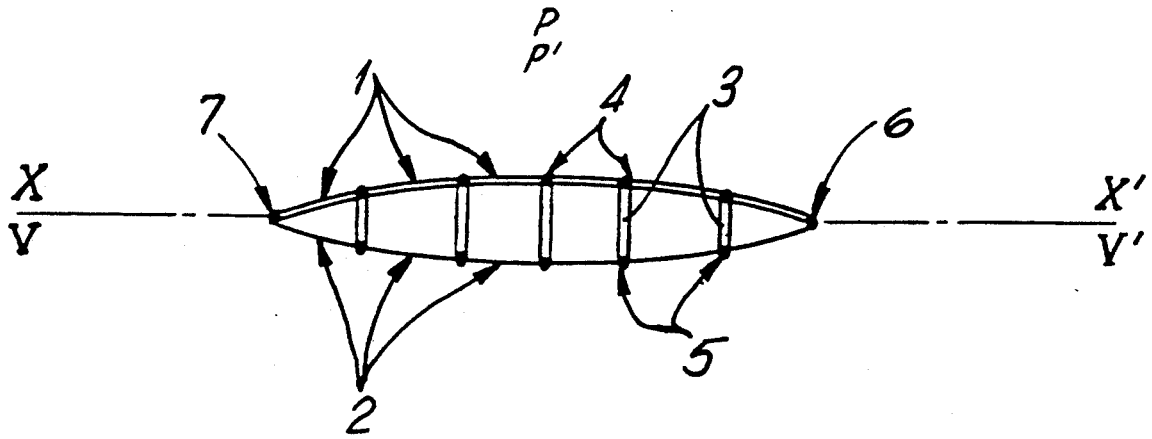
FIG. 2 is a vertical section of the structure of FIG. 1 along one tapered beam, i.e. along XX' or along YY'.

Referring first to FIGS. 1 and 2, there is shown schematically a typical structure based upon the invention principles. Such a structure comprises a number of interlocking beams P and P' of tapered shape each formed of standard elements. Such a beam is shown on FIG. 2. It comprises itself upper elements 1 in the form of tubes or bars, lower elements 2 in the form of rods or ropes and vertical struts 3 connecting each crossing point 4 between upper elements 1 to each crossing point 5 between lower elements 2. Both ends of each beams P, P' are connected to edge beams R, R' at 6 and 7 respectively.

According to a preferred modification, of the invention, all elements 1 and 2 are streched and kept prestressed, so that all strains resulting from climatic uplifts are transmitted to the ends 6 and 7 whereas the vertical struts 3 are constantly under compression.

Figure 4:
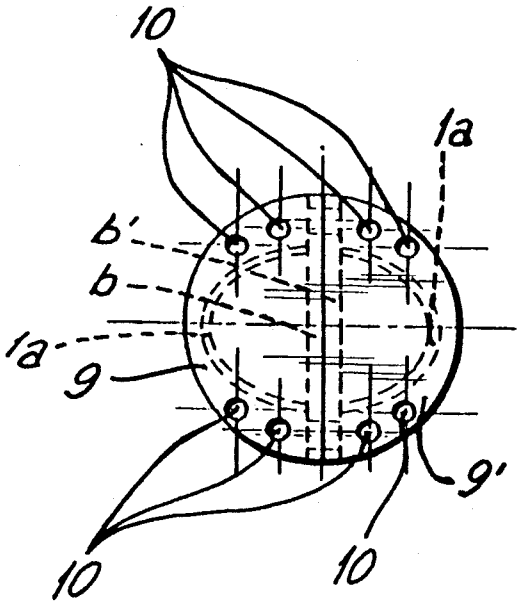
FIG. 4 is a vertical section along IV—IV of FIG. 3.
Figure 3:
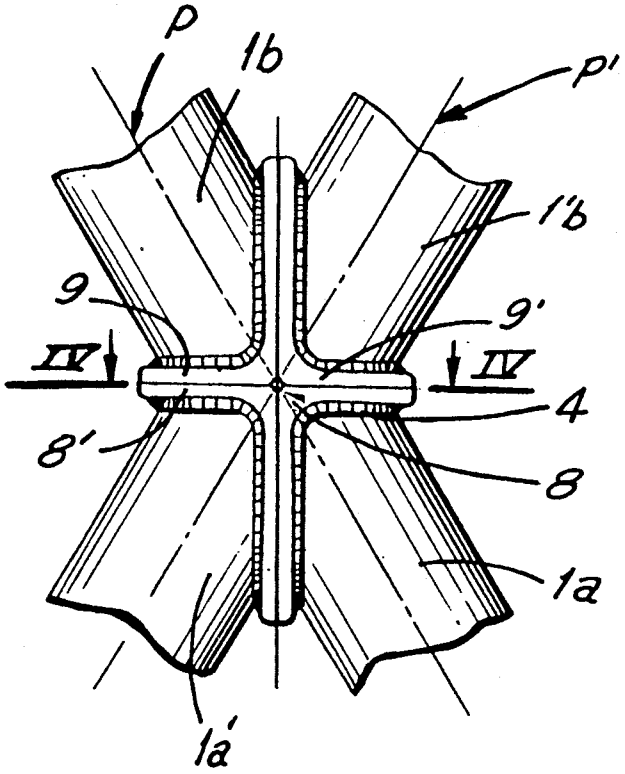
FIG. 3 is an enlarged top view of a part of FIG. 2, showning an upper connecting element.
Figure 5:
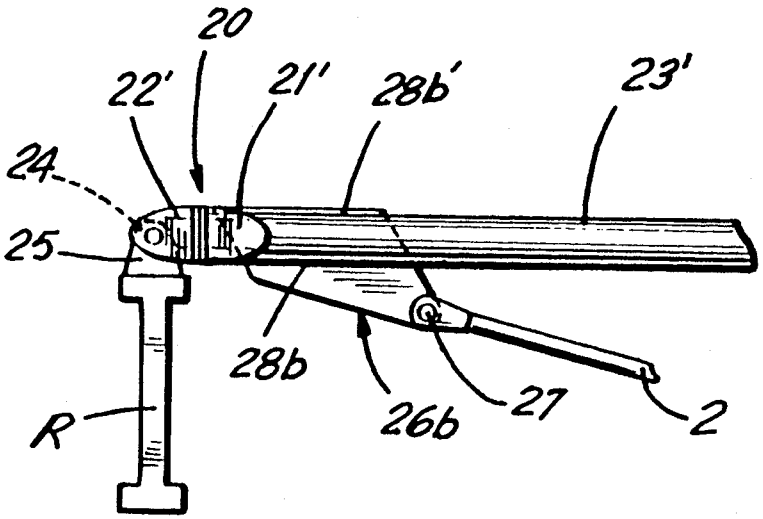
FIG. 5 is a side view of an edge connection.

According to the invention also, all elements 1, 2 and 3 are standardized and connected through connecting elements also standardized, which are shown in FIGS. 3 and 4 for the lower elements, corresponding to connections 5, and in FIGS. 5–6 for the edge connections 6 and 7.

Referring to FIGS. 3 and 4, it is shown how the elements 1*a* and 1*b* of a beam P and the elements 1'*a* and 1'*b* of a beam P' crossing beam P at the connection 4 are assembled in such a manner to create continuous lines, through four brackets 8, 9 and 8', 9' connected with bolts (not shown) inserted through holes such as 10 (FIG. 4), in their horizontal parts. The tubular elements 1*a* and 1'*a* are welded respectively to the brackets 8 and 8', whereas the tubular elements 1*b* and 1'*b* are welded to the brackets 9 and 9', so that by bolting 8 to 9'9 to 9', 9 to 8' and 8 to 8', it is provided that elements 1*a*, 1*b*, 1'*a*, 1'*b* and 4 are joined together.

Figure 9:
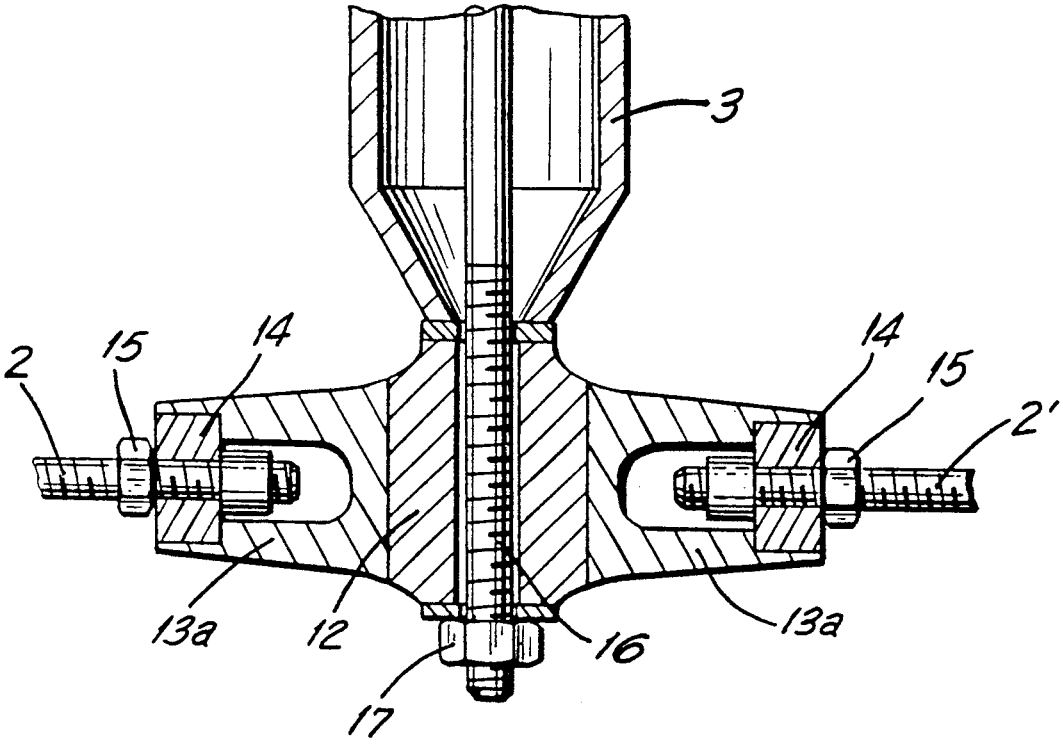
FIG. 9 is a modification of FIG. 8, showing a different connection with a lower horizontal beam.
Figure 10:
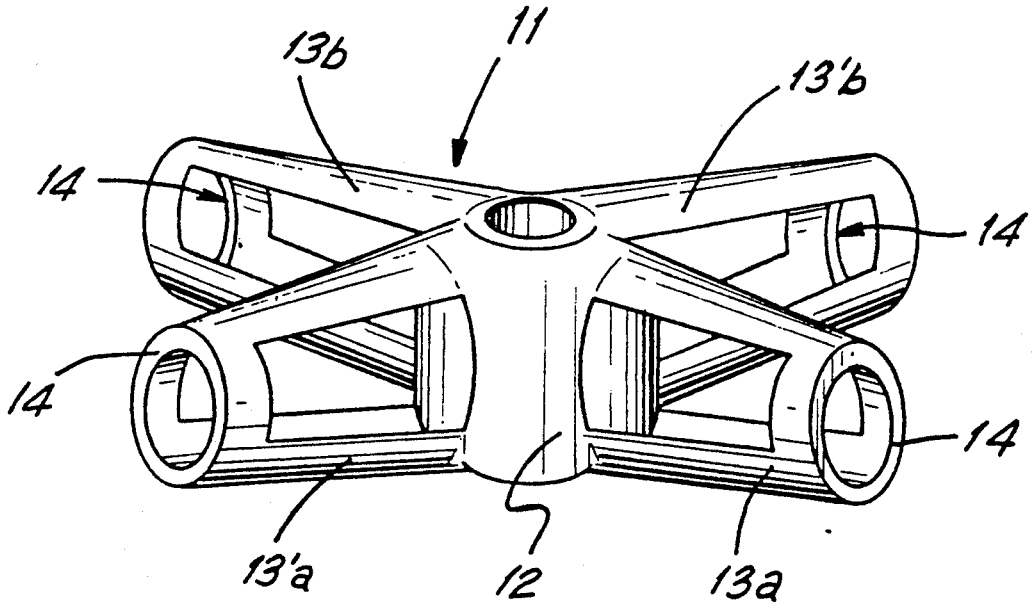
FIG. 10 is a perspective view of the connecting element of FIG. 5.

To join the lower elements 2 and the lower connecting points 5, it is provided a modification shown in FIGS. 9 and 10, involving a connecting element of molded steel (FIG. 10) comprising an axial bush 12 and four braces two by two symetrical 13*a*–13*b* and 13'*a*–13'*b* the bottom of which is punched to accomodate the respective rods 2—2' kept by adjustable nuts 15 to allow a precise lenghth adjustment and therefore the overall stress counterbalance of the system.

As shown on FIG. 9, the axial bush 12 can accommodate a positioning pin 16 with an adjustable nut 17, for the strut 3. Such a modification is optional since said vertical strut 3 is always under compression.

Figure 8:
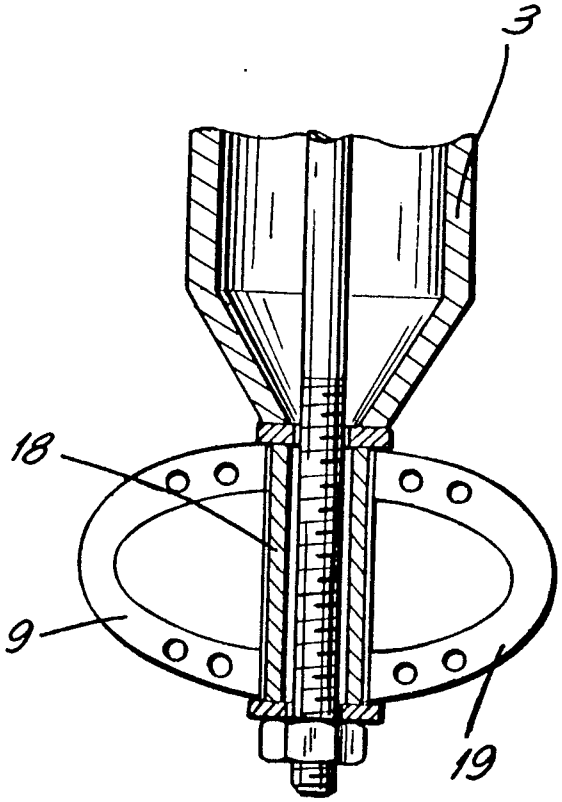
FIG. 8 is a vertical section similar to FIG. 4, but showing a different connection with a vertical strut.
Figure 7:
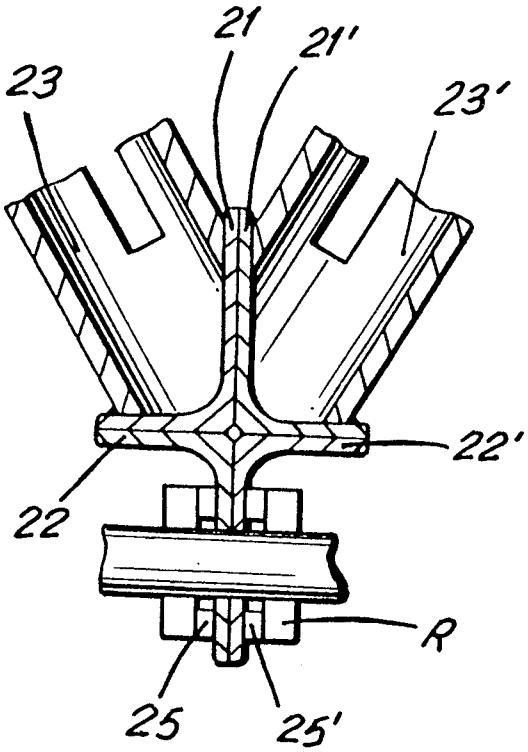
FIG. 7 is an horizontal section along VII—VII of FIG. 5.

Instead of the above modification, it can be used for the lower connections 5 connecting means similar to the one used for the upper connections 4, as illustrated by FIG. 8, a bush 18 similar to bush 12 being similarly provided at the center of brackets 19, to which are welded the ends of rods 2 and bolted together as brackets 8 and 9.

Referring now to FIGS. 5–7 and 11*a*–11*b*, it is shown a modification of the connections 4 and 5 at the connections points 6 and 7 of beams P and P' on the edge beams R and R'.

According to this modification the connecting element 20 (FIGS. 5 and 6) still comprises four brackets 21, 21' and 22, 22', but whereas the internal brackets 21—21' are welded to the tubular elements 23, 23' as in the modifications of FIGS. 3, 4 and 8, the external brackets 22, 22', bolted to 21, 21', bear a pivot 24 used for hooking a fork 25, 25' welded to the edge beam R.

In addition, the same connection 6 (or 7) used for connecting two lower rods 2, it is provided by the invention to obtain such connection through a gusset 26 hooked at 27 to the rod 2 and welded at 28 to the tube 23. According to the modification of FIG. 11*a*, such welding 28 is located on the external face of tube 23. To minimize the chances of ovalization of tube 23, it is preferred as shown in FIG. 11*b* to slit tube 23 along two opposed slots 29, 29', the gusset 26*b* being welded at 28*b* and 28*b*, diametrally opposed in tube 23.

It should be noted that, whereas according to its basic principles the lower sheet of the structure of the invention is made of rods 2, in the case of high range works it is difficult to prestress the tubular elements 1 so that they are no longer capable to bear all the climatic strains. In this case, it is provided by the invention to realize the lower elements 2 also as small tubes so that they can bear their part of the climatic compression efforts.

In the case of high range buildings, some dissymetry of charges can occur on the structure, for example by accumulation of snow in a corner, which has for consequence transfer and local distorsions.

Figure 16:
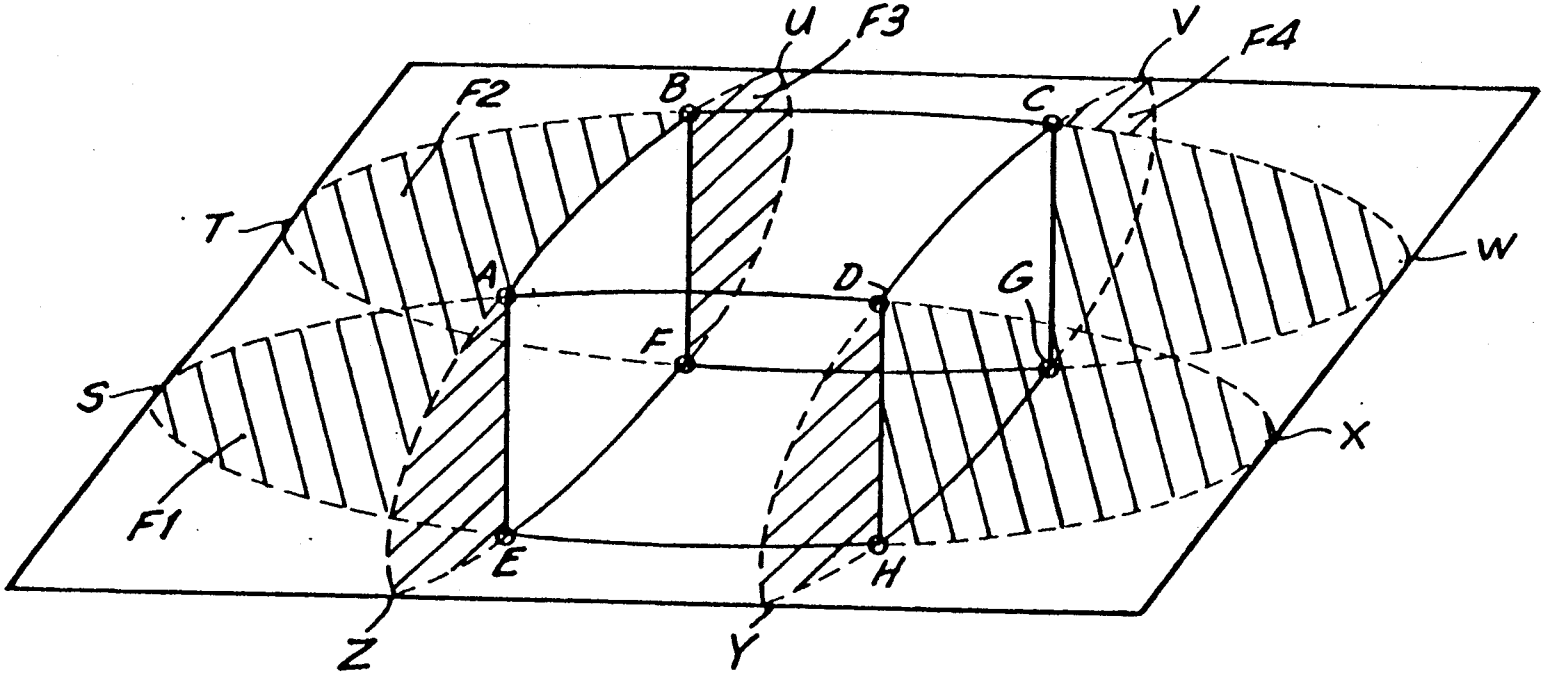

To prevent such parasitic phenomenons, it is provided by the invention to complete the structure with additional struts diagonally placed in all or a part of the elementary quadrilaters such as ABFE or ADHC in FIG. 16. Such diagonals have for effects that local strains can no longer distort the structure.

FIG. 12 shows in perspective such a complete configuration: there are shown as in FIG. 1 two series of tapered beams as shown on FIG. 2, i.e. beams A1, A2, A3 . . . interlocking with an angle of 60° with beams B1, B2, B3 . . . forming upper connections N1, N2, N3 . . . and lower connections N'1, N'2, N'3 . . . .

The beams A are made of upper tubes or bars a1, a'2, a'3 . . . , whereas in the same manner the beams B are made of upper tubes or bars b1, b2, b3 . . . and of lower rods or ropes b'1, b'2, b'3 . . . . Each couple of upper connections N corresponding to the crossing of tubes a and b and of lower connections N' corresponding to the crossing of rods a' and b', are connected by a strut E the heighth of which decreases from the central area of the structure to the edge thereof, where beams A are directly connected to beams B in points R.

Each quadrilateral in each vertical plane is defined by two successive vertical struts E and the corresponding segments of tubes a or a' and b or b' and has therefore the shape of a trapeze, the parallel bases of which are the struts E and the slant curviline sides are the segments a and a' or b and b' corresponding to the concerned beams.

As explained hereabove, in each of said trapezes are mounted diagonal struts T1, T2 . . . and T'1, T'2 . . . , which gives to the complete structure the complex shape of FIG. 12.

FIG. 12A is a transverse section of a station with platforms covered by an horizontal structure of the invention.

FIG. 12B is a transverse section of a store covered by horizontal structures, and FIG. 12C is a transverse section of a hall, e.g. a supermarket or a theater, covered by a couple of slant structures resting one upon the other.

Finally, FIG. 13 show as an illustrative example, a possible use of the invention for a more sophisticated architectural purpose. To this effect, at the apex 31 of a pole erected at the center of the structure is fastened a web 32 made of coated cloth, and having the shape of a tent. If the structure is of large dimensions, several poles can be distributed to create a cover, possibly of several webs, to create a new aesthetic effect.

A glass cover can also be created with diamond points corresponding to the lozenges made by the beams P, P'.

This invention comprises also a modification according which, by a more sophisticated system of connecting points N, N', it is possible to create curved or contoured structures adapted to unusual works; it can be given to a structure a frusto-conical contour for covering e.g. a stadium or a theater or an architectural area of large range. The elements of such a structure are also standard, which is the essential of the invention, the modification of the connecting point allowing an angular range of movement of said elements in all directions, which renders possible creating in any beam a warping through which it self-adapt to the overall shape of the structure, only the length of the basic elements being different from one beam to another.

This modification is illustrated by FIGS. 14 and 15 showing a strut E with an upper connecting point N, and a lower connecting point N2.

According to this modification, each connecting point N1 or N2 comprises a series of upper rings 101, 102 . . . , and lower rings 101', 102' . . . , slipped on the strut ends and blocked by a disc 201, 201', immobilized by a nut 202.

To said rings are welded lugs 301, 302 . . . , 301', 302' . . . in holes thereof are placed, in the present case, kneel joints 401, 402 . . . , 401', 402', . . . . Said joints are used for connecting forks 501, 502 . . . 501', 502' . . . , at the ends of the tubes B and B', forming the tapered beams of the structure and the ends of the brace T1 diagonally mounted in the trapezes formed by two struts and the segments of elements B1—B'1 connected therewith.

This modification of the connecting point has for interest to offer the possibility to give to the elements joined therewith any orientation corresponding to a given contour of the structure, each beam having the ability to take a wrap shape resulting from the self-adaption of the orientation of at least one of its basic elements, by rotation of the ring on which this element is mounted and/or of the corresponding rotula when the structure is assembled, being understood that the lenghth of each element is calculated in advance depending upon the analysis of the fixed structure shape in view of the net to create for obtaining a balanced partitioning.

Instead of ball and socket or knee joint, it can be used in points N any similar mechanical system having the same effect, i.e. a cardan joint, a spherical joint and the same.

I claim:

1. A building structue comprising: a plurality of beams, each beam having a central portion and two end portions, each beam tapering from its central portion to its respective end portions, the number of said beams being a multiple of four, each of said beams having a first and second surface, said beams being interlocked along a regular pattern such that the first surfaces of said beams form an upper sheet and the second surfaces of said beams form a lower sheet; means for connecting said sheets to one another; and edge beams for connecting the end portions of said beams to one another; said upper sheet comprises standard tubular elements each end of which is welded to a bracket in such a manner that the ends of four tubular elements are joined by bolting of the four corresponding brackets, the connecting points of the upper sheet being connected by vertical struts to the connecting point of the lower sheet.

2. Building structure according to claim 1 characterized in that the elements of the lower sheet are braces the length of which can be adjusted in relation with the strains exerted on the upper elements transmitted by the vertical struts.

3. Building structure according to claim 1 characterized in that the elements of the lower sheet are tubes of small diameter.

4. Building structure according to claim 1 or 3 characterized in that the ends of the tapered beams located on the edge beams two tubular upper elements are welded to two acting as an hinge upon a pin fixed to said edge beam.

5. Building structure according to claim 4, characterized in that the ends of the lower elements corresponding to said tubular elements are welded thereto along two diametrically opposed welding lines.

6. Building structure according to claim 5, characterized in that additional struts are diagonally fixed in at least a number of the meshes formed by one upper element, one lower element and the two vertical struts connecting them.

7. Building structure according to claim 6, characterized in that at least a part of the elements of the structure are prestressed before assembling.

8. Building structure according to claim 4, characterized in that on each strut are slipped a series of rotable rign on which are welded jugs used as a part of ball and socket joints the other parts being a fork at the end of each structure element.

9. Building structure according to claim 1, characterized in that in view of building sophisticated structure having a contoured structure, the upper and lower end of the struts through mechanical systems giving to each end a range of movement in at least two perpendicular planes.

10. A building structure comprising a plurality of beams, each beam having a central portion and two end portions, each beam tapering from its central portion to its respective end portions, the number of said beams being a multiple of four, each of said beams having a first and second surface, said beams being interlocked along a regular pattern such that the first surfaces of said beams form an upper sheet and the second surfaces of said beams form a lower sheet, each beam including a plurality of upper prestressed tubular elements, a plurality of lower tubular elements of adjustable length, upper connecting elements for connecting said upper elements to one another, lower connecting elements for connecting said lower elements to one another, vertical struts for connecting said upper elements to said lower elements, and edge connecting elements for connecting the end portions of said beams to one another; said upper sheet comprises standard tubular elements each end of which is welded to a bracket in such a manner that the ends of four tubular elements are joined by bolting of the four corresponding brackets, the connecting points of the upper sheet being connected by vertical struts to the connecting points of the lower sheet.

* * * * *